United States Patent [19]

Knopp

[11] 3,945,633

[45] Mar. 23, 1976

[54] HOPPER LOADER

[75] Inventor: Arthur Albert Knopp, Stockertown, Pa.

[73] Assignee: Harris-Intertype Corporation, Cleveland, Ohio

[22] Filed: July 23, 1973

[21] Appl. No.: 381,870

[52] U.S. Cl. ..... 271/3.1; 271/97; 271/30 A; 271/150; 271/199; 271/202; 271/221

[51] Int. Cl.[2].. B65H 1/30; B65H 3/08; B65H 31/38

[58] Field of Search ..... 271/DIG. 7, 6, 7, 150, 271/151, 97, 105, 198, 199, 221, 222, 195, 49, 31, 200–203, 30 A, 34; 214/60

[56] References Cited

UNITED STATES PATENTS

| | | | |
|---|---|---|---|
| 958,798 | 5/1910 | Fischer et al. | 271/222 |
| 2,486,415 | 11/1949 | Huntar | 214/6 D |
| 2,693,885 | 11/1954 | Junco | 214/6 D |
| 2,779,592 | 1/1957 | Hartman | 271/DIG. 7 |
| 2,911,216 | 11/1959 | Richardson | 271/95 |
| 3,240,488 | 3/1966 | Lyman | 271/30 A X |
| 3,522,943 | 8/1970 | Swanson | 271/6 |
| 3,547,431 | 12/1970 | Wagner | 271/97 |
| 3,565,423 | 2/1971 | Kluth | 271/199 |
| 3,598,400 | 8/1971 | Nelson | 271/150 |
| 3,643,939 | 2/1972 | Nussbaum et al. | 271/DIG. 7 |
| 3,674,258 | 7/1972 | Maier et al. | 271/202 |
| 3,690,650 | 9/1972 | Maier et al. | 271/3.1 X |
| 3,756,591 | 9/1973 | Müller | 271/3.1 X |

*Primary Examiner*—Evon C. Blunk
*Assistant Examiner*—Bruce H. Stoner, Jr.

[57] ABSTRACT

A hopper loader delivers a shingled stream of signatures to a hopper from which the signatures are fed. The hopper loader apparatus is portable and comprises a generally horizontal first conveyor belt section for receiving an array of side-abutted signatures on edge. The apparatus also includes an inclined second conveyor belt section for engaging the side of the signatures and for feeding the signatures from the array in an overlapped stream toward the hopper. The apparatus includes a means for adjusting the speed of the first belt section relative to the second belt section. Also the apparatus includes a presser belt construction which cooperates with the inclined section for pressing on the signatures to provide a sufficient frictional force between the belts and the signatures so that the signatures will be properly moved up the inclined belt section. In addition, a blower is utilized to provide a separating action to facilitate separation of the signatures in the array and to blow the top edge of the signatures toward the inclined belt. The conveyor belt sections are controlled in response to a pile height sensor which is located in the hopper. A suitable control is provided for sensing when the amount of signatures on the first belt section is depleted to a predetermined minimum and when such a minimum supply of signatures on the first belt section is sensed, the hopper loader mechanism is deactivated.

20 Claims, 11 Drawing Figures

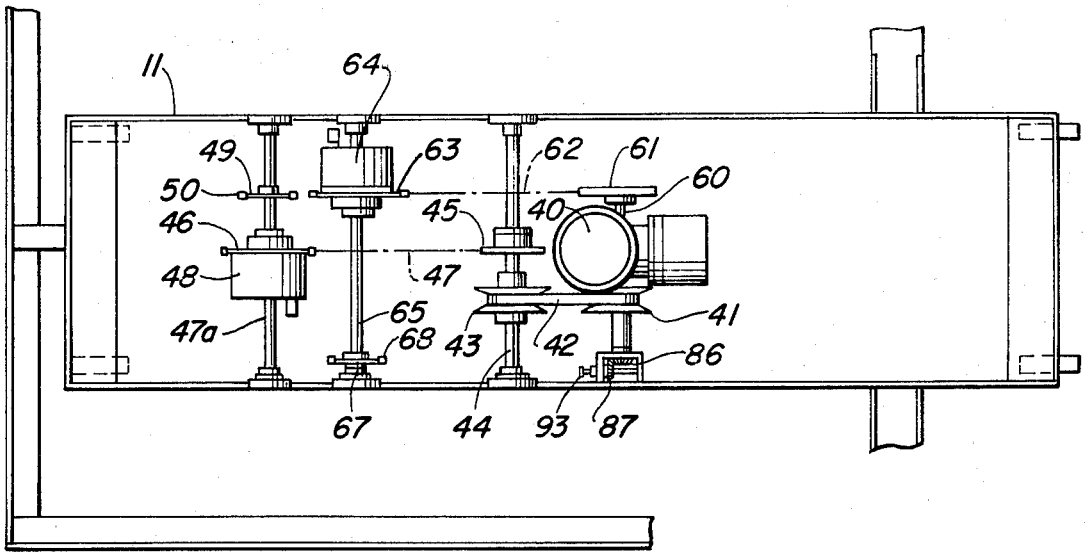
FIG. 5
FIG. 6
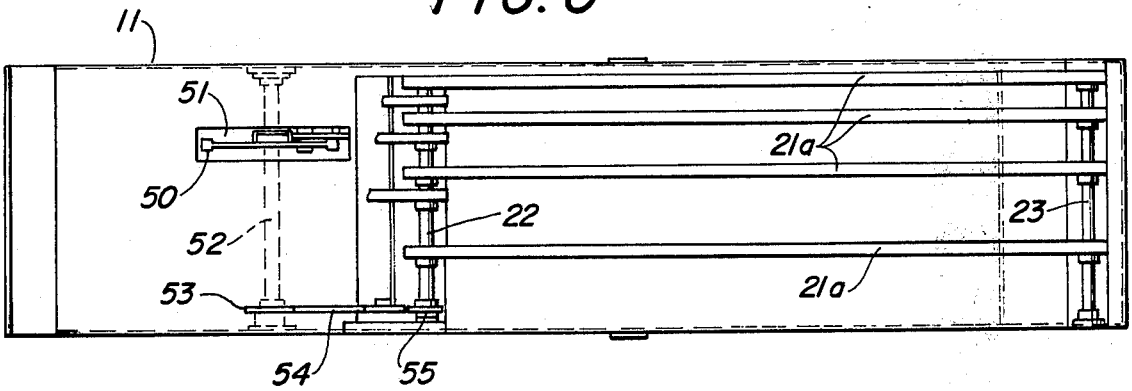
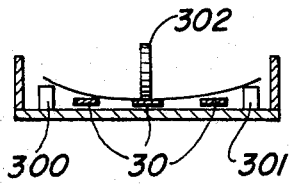
FIG. 10
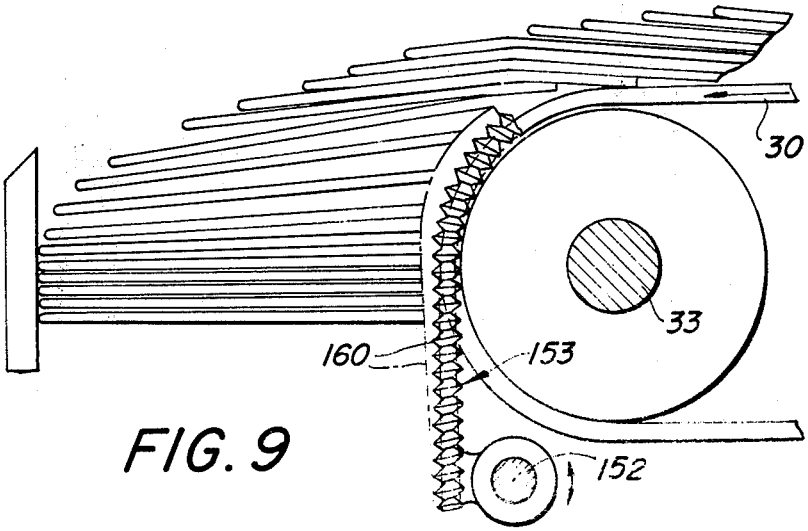
FIG. 9

HOPPER LOADER

BACKGROUND OF THE INVENTION

The present invention relates to an apparatus for automatically feeding signatures to a hopper, from which the signatures are fed. The hopper which is supplied with signatures by the apparatus of the present invention may be a hopper of a conventional gathering or inserting machine, and the apparatus to which the present invention relates has been termed a hopper loader. The advantages of automatically supplying signatures to a hopper as opposed to manual loading of the hoppers are well known. For efficient operation as a gathering machine, the supply of signatures in the hoppers thereof is important. If the supply is too low or too high, the gathering machine may not operate properly. Typical hopper loader constructions known in the art are shown in U.S. Pat. Nos. 3,690,650; 3,674,258; 3,505,719, and 3,522,943. In addition, German Application No. 2,131,258 also discloses a hopper loader construction. Also pending application Ser. No. 31,007, assigned to the assignee of the present invention, discloses a hopper loader construction.

SUMMARY OF THE PRESENT INVENTION

The present invention is directed to an improved hopper loader construction and particularly one which receives signatures in a stacked, on-edge side-abutting relationship and where the signatures are fed on edge by a first conveyor to a second conveyor which feeds the signatures in an overlapped stream into the hopper. One feature of the present invention is specifically directed to establishing a controlled amount of the lap (also referred to as signature overlap) which is provided in the stream of signatures and for providing a controlled lap, even though signature dimensions may vary. Not only is the present invention directed to the control of the lap, but it is also directed to the maintenance of that lap once it has been established.

In addition, the present invention is directed to the provision of various adjustments to the hopper loader construction and which adjustments may be made at the respective ends of the hopper loader. This is important, due to the fact that the hopper loaders for certain gathering equipment may be placed side by side for feeding adjacent hoppers in a gathering machine, and in such an application of the hopper loader it is impossible for an operator to move between the hopper loader constructions, and accordingly it is necessary for purposes of adjustment of the hopper loader that the operator make those adjustments from the ends of the hopper loader.

In addition, another feature of the present invention involves the provision of a suitable contol mechanism which stops the hopper loader apparatus in the event that the supply of signatures in the hopper loader for delivery to the hopper reaches a predetermined minimum. Such a provision is desirable due to the fact that if the supply of signatures in the hopper loader is depleted too far, the operator is unable to reach from the end of the hopper loader and load the hopper loader with sufficient additional signatures to maintain the side-abutting relation of the signatures in the supply section of the hopper loader. In the event that the supply of signatures in the hopper loader becomes diminished, problems with gaps on the inclined belt section between the signatures can occur and control of the signatures is sacrificed.

In addition, the construction of the hopper loader is such that a pile-height sensor in the hopper, which is being fed, triggers the actuation of the conveyor mechanism in the hopper loader. When the sensor in the hopper is satisfied, a timer is actuated so as to continue the feed of signatures into the hopper to maintain a suitable supply of signatures in the hopper and thereby minimize cycling of the hopper loader apparatus. The time that the conveyor belts continue to operate after the sensor is satisfied is adjustable.

Moreover, the hopper loader construction of the present invention is such that the conveyor belts which are driven from an electric motor may be reversed in operation. As a result, any signatures which may remain in the hopper loader at the time that the signatures are no longer needed may be removed by reversing the conveyor belts. This feeds the signatures back from the delivery end of the hopper loader adjacent the hopper to the supply end where an operator may remove the signatures from the hopper loader, either manually or by allowing the signatures to fall into a container.

DESCRIPTION OF THE DRAWINGS

The various features of the present invention will be better understood from a detailed description of a preferred embodiment thereof made with reference to the accompanying drawings in which:

FIG. 5 is a view of the drive of the hopper loader taken approximately along the line 5—5 of FIG. 2;

FIG. 6 is a view of the hopper loader of FIG. 2 taken approximately along the line 6—6 of FIG. 2;

FIG. 9 is a schematic view of a jogger mechanism utilized in the hopper loader of FIG. 1; and FIG. 10 is a schematic view of a portion of the hopper loader, and of general construction.

DESCRIPTION OF THE PREFERRED EMBODIMENT

Figures 1, 1A:
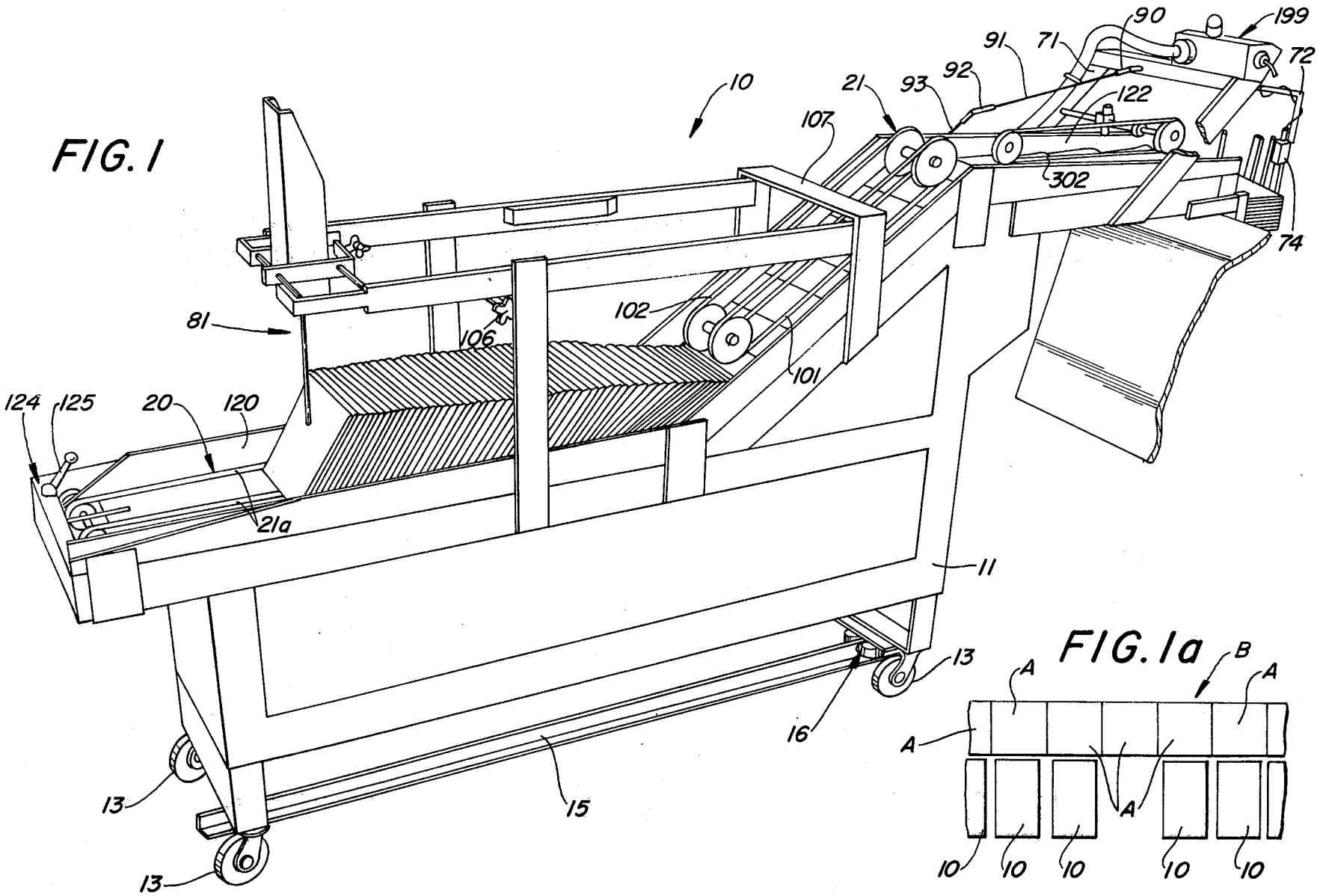
FIG. 1 is a schematic pictorial view of a hopper loader with parts removed embodying the present invention.
FIG. 1*a* is a schematic view showing a plurality of hopper loaders associated with a gatherer.

The hopper loader which embodies the present invention is generally shown in FIG. 1 and designated 10. The hopper loader 10 includes a frame 11 which includes a plurality of legs which have rollers 13 on the ends thereof. The rollers 13 engage the floor or support for the hopper loader. The rollers 13 provide for portability of the hopper loader construction, and the hopper loder construction is a unitary self-contained unit, as will be apparent from the description hereinbelow. It may be moved on the rollers into association with different hoppers in a gathering machine, or the like. In fact, as shown in FIG. 1*a*, a plurality of hopper loaders 10 may be used to deliver signatures into a plurality of hoppers A of a gathering machine B. When so used, the adjacent hopper loaders 10 are positioned quite close together. As shown in FIG. 1*a*, a hopper loader 10 is associated with each hopper of the gatherer B for the middler hopper. As shown in the drawings, when associated with a hopper, the hopper loader is moved relative to a rail 15 and a suitable roller mechanism 16 cooperates with the rail 15 to prevent the hopper loader from moving laterally of the rail 15.

In general, the hopper loader includes a first conveyor belt section which is generally designated 20, and a second conveyor belt section which is generally designated 21. The first conveyor belt section 20 includes a plurality of belts designated 21*a* and which are trained around pulleys at the opposite ends of the belts. The pulleys at one end of the belts 21*a* are connected to a drive shaft 22 and at the other end of the belts are connected to an idler shaft 23. Of course, driving of the drive shaft 22 effects drive of the belts 21*a*.

Figure 4:
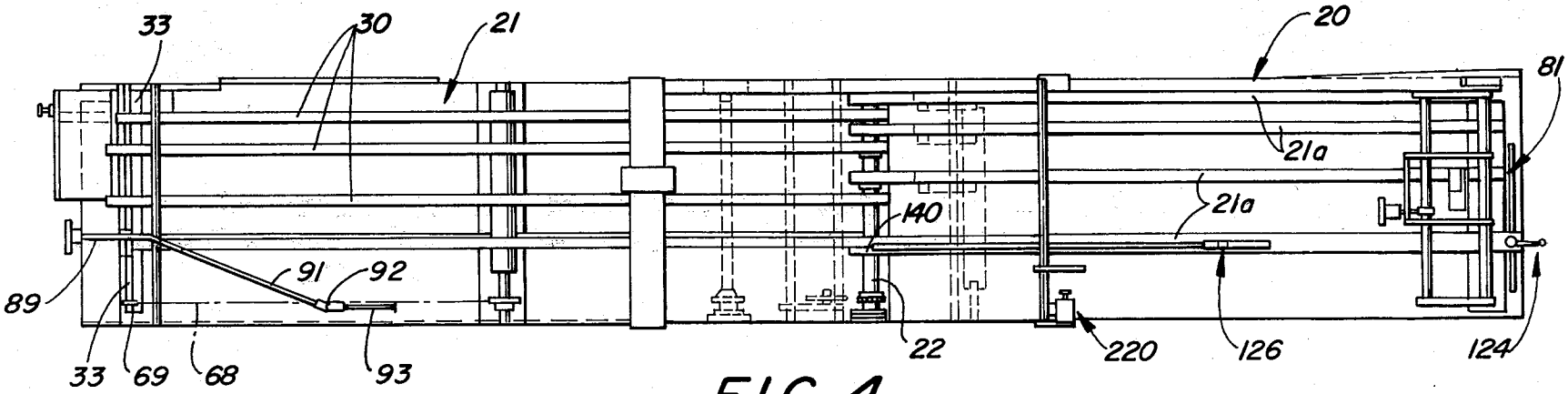
FIG. 4 is also a plan view of the hopper loader similar to FIG. 3 but with different parts removed.

The second conveyor belt section 21 also includes a plurality of conveyor belts, as shown in FIG. 4, and which are designated 30. The conveyor belts 30 are trained at one end around a plurality of pulleys which are rotatably mounted on the drive shaft 22 for the belts 21*a*. The pulleys around which the belts 30 are trained are not driven by the shaft 22. They are rotatable relative to the shaft 22. The opposite ends of the belts 30 are trained around pulleys which are drivingly connected to a drive shaft 22, and are driven upon driving of the shaft 33.

Figure 2:
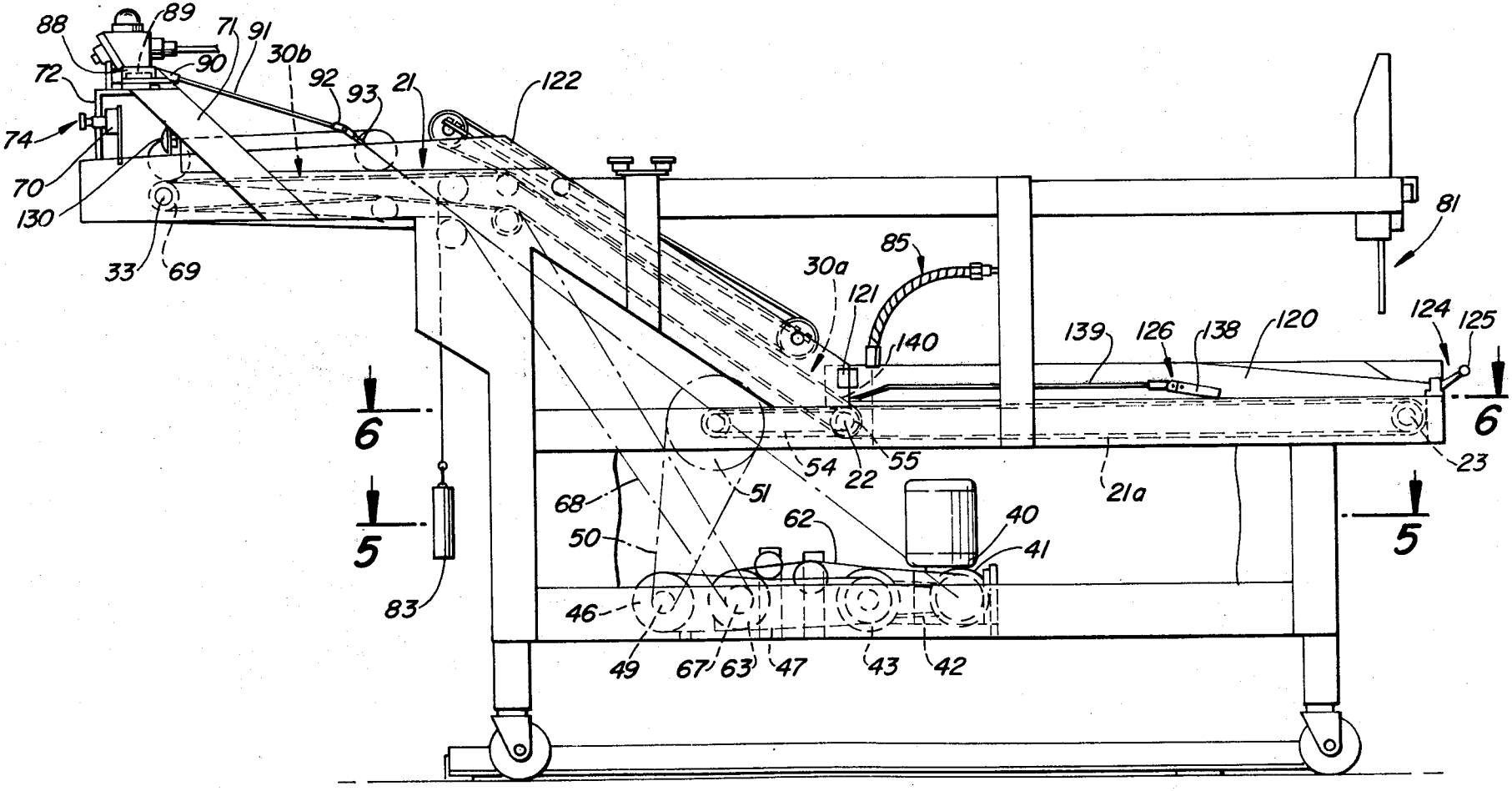
FIG. 2 is a side elevational view of the hopper loader of FIG. 1.

The conveyor belts 30 are formed into an inclined section which is generally designated 30*a*, as shown in FIG. 2, and a horizontal section generally designated 30*b* in FIG. 2. The conveyor section 30*b* delivers signatures from the end thereof into the hopper being supplied by the apparatus 10. The conveyor belts 30 and 21*a* are provided with suitable belt guide rollers and/or suitable tensioning devices in order to provide the proper path for and tensioning in the belts, and such devices also will not be described in detail.

The drive to the belts 21*a* is from a motor 40, best shown in FIG. 5, through a variable speed or adjustable pulley 41. The pulley 41 drives a belt 42 which is trained around a pulley 43 which is driven by the belt 42. The pulley 43 is mounted on a shaft 44. Also mounted on the shaft 44 is a sprocket 45. The sprocket 45 has a chain 47 trained around it and the chain 47 is also trained around a sprocket 46. The sprocket 46 is drivingly connected to a shaft 47a through a clutch 48. When the clutch 48 is energized, the shaft 47*a* is rotated with a sprocket 46. When the clutch 48 is not energized, the sprocket 46 may rotate relative to the shaft 47*a* and no drive is transmitted therebetween. The clutch 48 may be of any conventional construction and will not be described in detail, it being an electrically operated clutch so that when it is energized, it will transmit drive from the sprocket 46 to the shaft 47*a*.

Carried on the shaft 47*a* is a sprocket 49 which has a chain 50 trained around it. The chain 50 is also trained around a sprocket 51 (see FIGS. 2 and 6) which is carried on a shaft 52 supported in the upper portion of the frame 11. The shaft 52 carries a sprocket 53 which has a chain 54 trained around it. The chain 54 drives a sprocket 55 which is fixedly and drivingly connected with the shaft 22. Accordingly, the motor 40 drives the shaft 22 and the belts 21*a* when the clutch 48 is energized at a speed regulated by the adjustable pulley 41.

The drive to the belts 30 is also from the motor 40, the motor 40 having a second output shaft 60 which carries a sprocket 61. The sprocket 61 has a chain 62 trained around it and the chain 62 is also trained around a sprocket 63. The sprocket 63 is associated with a clutch mechanism 64 and the clutch mechanism 64, when energized, is drivingly connected with a shaft 65. When the clutch 64 is not energized, no drive is transmitted between the sprocket 63 and the shaft 65. The clutch mechanism 64 is similar to the clutch mechanism 48 and will not be described in detail. The clutch mechanism 64 is an electrically operated clutch and, when energied, does transmit the drive from the sprocket 63 to the shaft 65. A sprocket 67 is drivingly connected with the shaft 65 and a chain 68 is trained around the sprocket 67 and extends upwardly and forwardly to a sprocket 69 which is drivingly connected with the shaft 33 to effect driving of belts 30.

The size of the various sprockets in the drive train to the belts 21*a*, as well as in the drive train to the belts 30, are selected so that the belts 30 are driven at a substantially higher speed than the belts 21a, as will be apparent from the description hereinbelow. Also, the clutches 64 and 48 are energized simultaneously in order to effect the driving of the belts when it is desired to supply signatures to the hopper and the clutches 64 and 48 are controlled from a sensor 70 which is supported on a forward frame portion 71 of the hopper loader frame 11. The sensor 70 is suitably supported on a rod 72 and the rod 72 is adjustable laterally of the hopper by suitable adjustment mechanism, generally designated 73. The sensor 70 is also adjustable vertically on the rod 72 by suitable adjustment mechanism, generally designated 74.

The sensor 70 comprises a pile-height detector sensor or switch which has a feeler finger which engages the signatures in the pile. The switch is held in an open position when a predetermined number of signatures are in the hopper, but moves to a closed position when the number of signatures in the hopper reach a predetermined minimum as sensed by the feeler finger. When the switch contacts in the sensor 70 are closed due to the fact that the supply of signatures in the hopper has reached a predetermined minimum, clutches 64 and 48 are energized to effect actuation of the belts 21*a* and 30 to drive the belts and thereby feed additional signatures into the hopper.

Figure 7:
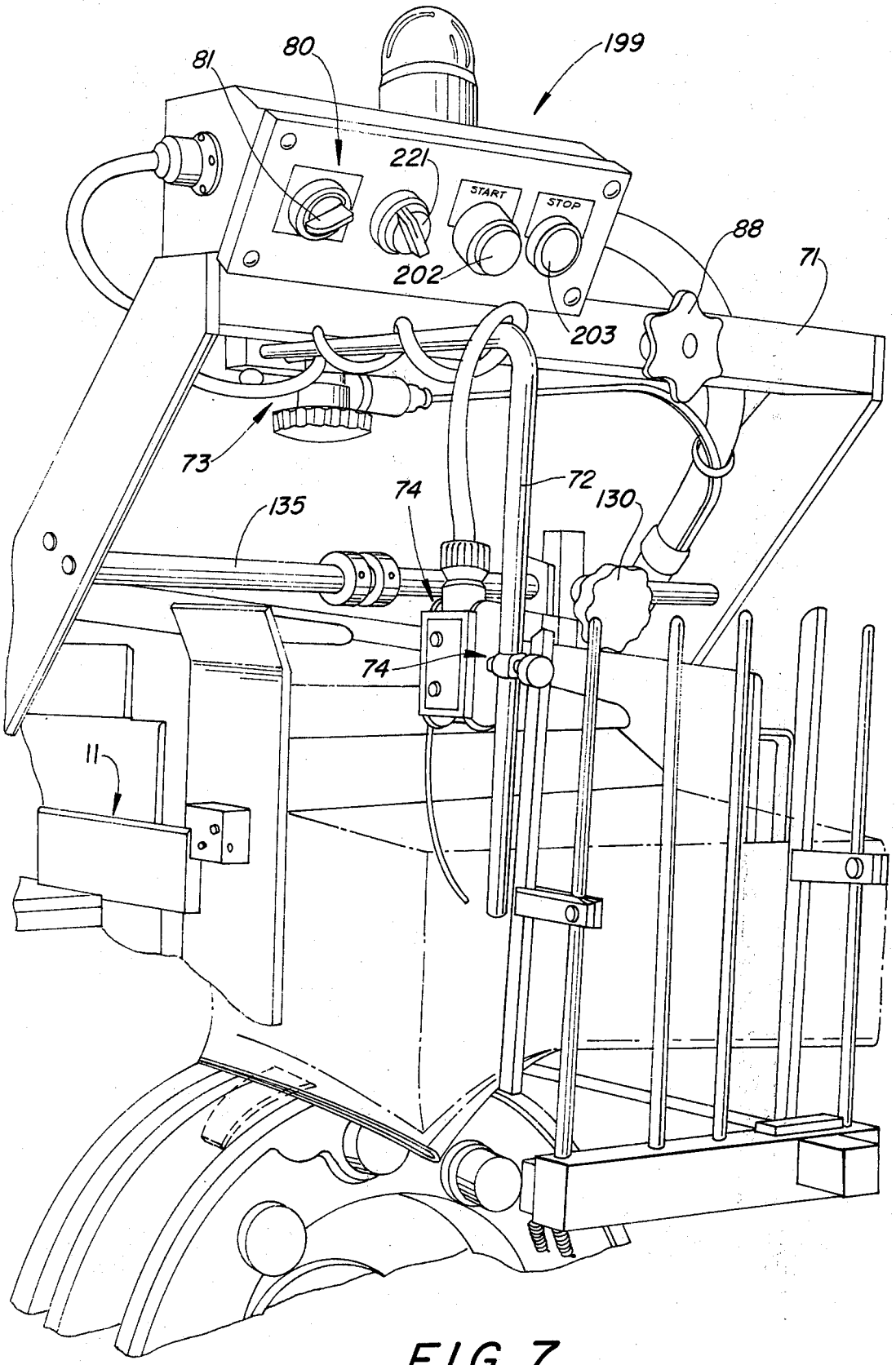
FIG. 7 is a perspective view of the output end of the hopper loader showing the relationship of the hopper loader with a hopper which is being supplied by the hopper loader.
Figure 8:
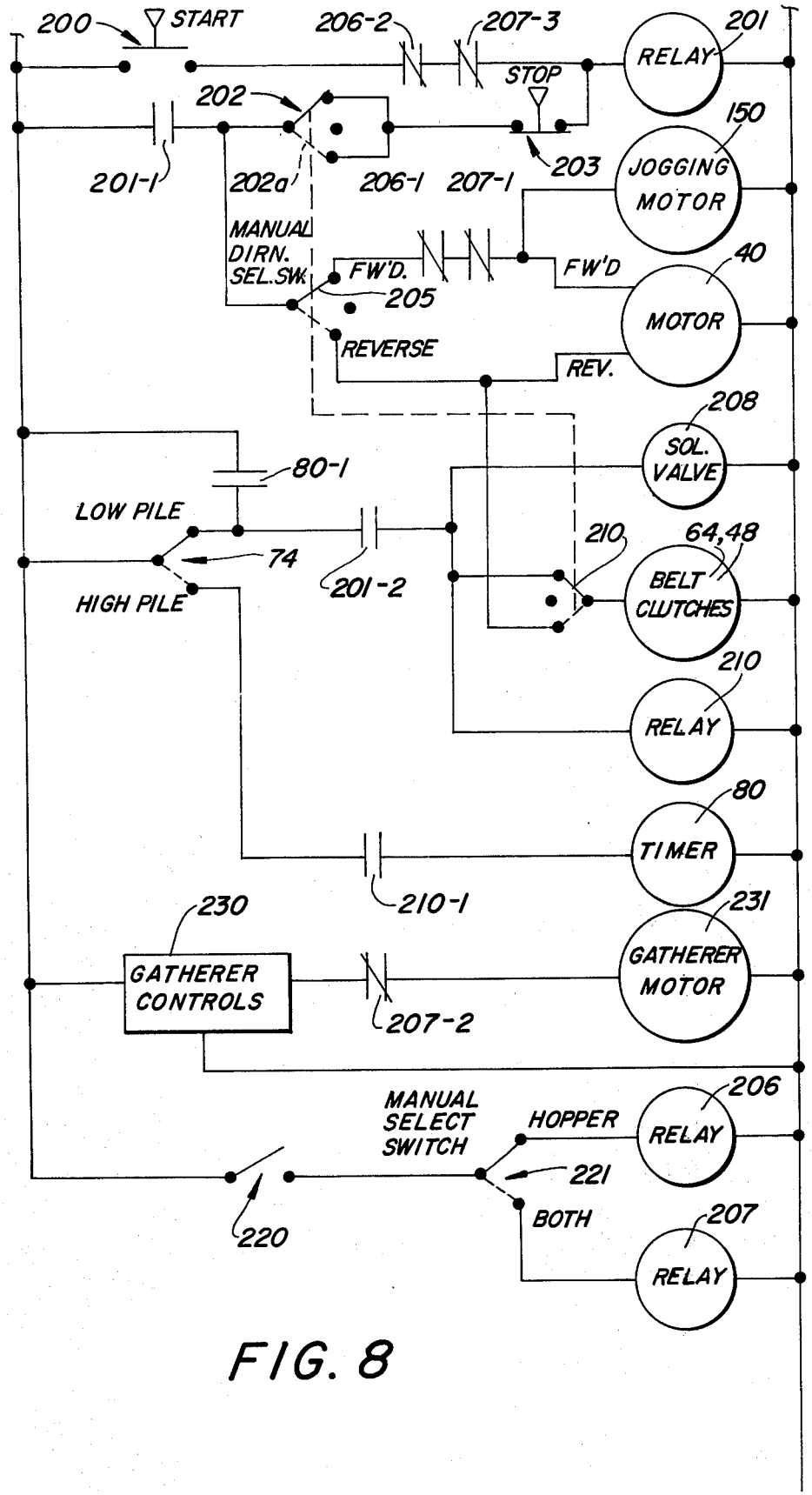
FIG. 8 is a schematic control circuit diagram illustrating the circuit controls which are in the hopper loader construction of FIG. 1.

Also, suitably provided in the control circuit for the clutches 48 and 64 is a timer device, generally designated 80, and shown schematically on the circuit diagram in FIG. 8. The timer 80 is provided so that once the sensor 70 is satisfied, that is, a suitable number of signatures have been delivered to the hopper, the timer 80 is actuated in order to maintain the clutches 64 and 48 energized for a predetermined time interval after the sensor is satisfied. This time interval provides for continuing the feed of signatures into the hopper, even though the sensor has been satisfied. As a result, a proper number of signatures can be fed into the hopper so as to minimize cyclic operation of the conveyors, i.e., frequency stopping and starting of the conveyor belts during the operation of the apparatus. Suitably supported at the end of the hopper loader 10 is an adjustment knob, generally designated 81, best shown in FIG. 7, for adjusting the time delay or time for which 80 will maintain the clutches 48 and 64 energized after the sensor has been satisfied. Further description of the operation in this connection will be made hereinbelow in the description of the circuitry shown in FIG. 8.

From the above, it should be apparent that the conveyor belt section 30*a* is inclined relative to the conveyor belt section 20. The signatures which are to be delivered to the hopper are placed on edge in a side-abutting relationship on the conveyor belts 21*a* by the operator of the apparatus. A suitable follower mechanism, generally designated 81, is provided for engaging the rear or lastmost signature in the stack of on-edge signaures on the conveyor belts 21*a* and to prevent the rearwardmost signatures from sliding rearward onto the conveyor belt section 20*a*. The mechanism 81 is weight-biased toward the left in FIG. 2 and is moved toward the left by the weight 83 as the signature supply diminishes. The mechanism 81 includes a vertically retractable blade disclosed in application Ser. No. 381,881, now U.S. Pat. No. 3,904,191, filed concurrently herewith, and that disclosure is incorporated herein by reference. The blade likewise may be manually pulled against the weight 83 for purposes of depositing additional signatures on edge of the belts 21*a*. As the signatures move on edge in a direction toward the left, as viewed in the drawings, the lead signature in the stack of signatures on the conveyor belts 21*a* tips downwardly and moves into engagement with the conveyor belts 30. The conveyor belts 30 then move the signatures into the hopper.

In order to accomplish the stream feed of the signatures along the conveyor belts 30, it is necessary for the signatures to tip over as described above. In addition, it is necessary to provide the proper speed ratio between the conveyor belts 21*a* and the belts 30. Also, in order to ensure that the signatures are properly formed in the stream, a blower mechanism, generally designated 85, is provided for applying a downward air flow on the top edges of the signatures in order to break away or facilitate the breaking away of the signatures from the remaining signatures in the stack on the belts 21*a* and to drive these signatures toward the inclined belt 30. The blower is turned on only when the belts are running.

The proper speed relationship between the belts 21*a* and the belts 30 may be adjusted by adjusting the speed of the belts 21*a* relative to the belts 30. This speed adjustment is effected by adjustment of the variable speed pully 41. The variable speed pulley 41, as shown in FIG. 5, is of a conventional construction and will not be described in detail. It does, of course, include a movable flange for effecting the drive adjustment. A suitable gear mechanism including a pinion gear 86 which is drivingly connected with the movable flange part of the variable speed pulley 41, when rotated, effects adjustment of the movable flange part of the adjustable speed pulley 41 through a threaded interconnection therebetween (not shown). The gear 86 meshes with a gear 87 and upon rotation of the gear 87, the gear 86 is likewise rotated in order to effect adjustment of the speed ratio between the pulleys 41 and 43.

The gear 87 is rotated from the front of the apparatus 10 by rotation of a knob 88. The knob 88 is suitably connected so that upon rotation, the knob rotates a shaft 89. The shaft 89 is connected through a universal joint 90 to a shaft 91. The shaft 91 is connected by a universal joint 92 to a shaft 93 on which the pinion 87 is drivingly connected. Accordingly, by rotation of the knob 88, the pinion 87 is rotated and the speed ratio between the pulleys 41 and 43 is varied. In this manner, the speed of rotation of the belts 21*a* may be varied relative to the speed of the belts 30.

As noted, this adjustment of the speed of the belts 21a is provided at the front end of the apparatus so as to facilitate adjustment by the operator. By controlling the relative belt speeds, the lap of the signatures on belts 30 can be controlled. Also, the blower assists in the lap control. These controls are important, particularly for different thickness signatures as well as different height signatures.

Not only does the apparatus provide for the establishment of the proper lap for signatures of different thickness and height, as noted hereinabove, but also the apparatus provides for maintaining that lap, even though the signatures move up the inclined section 30*a* of the conveyor belt. The lap is maintained by a presser belt construction, which is generally designated 100. The presser belt construction 100 includes a pair of presser belts 101 and 102 which are supported in a spaced relationship to engage the upper surface of the signatures and apply a force on the signatures as they move up the section 30*a* of the conveyor 30. In the absence of the presser belts 101, 102, the signatures may slide downwardly relative to each other. The presser belts 101, 102 are mounted in a frame 103. The frame 103 has pulleys at its opposite ends and the presser belts 101 and 102 are supported around those pulleys. The belts 101 and 102 are merely idlers and are not positively driven.

The frame 103 is supported for pivotal movement about a horizontal axis by a suitable pin construction 105. The weight of the frame pivots the frame about the pivot axis 105 and accordingly the belts are pressed or weight-biased against the upper surface of the signatures. The frame 103 is supported by a bracket 106 which in turn is supported on a cross frame 107 which bracket also supports the pivot construction 105.

The frame 103 of the presser belt construction is supported for linear adjustable movement relative to the bracket 106. This adjustment is provided by a sliding support section on the bracket 106 which supports the frame 103 for sliding movement along the inclined section 30*a*. The adjustment of the frame 103 alson the belts 30*a* is provided by a suitable adjustment mechanism, generally designated 105*a*.

The mechanism 105*a* includes a handle 108 to which a suitable cable 109 is secured. By rotation of the handle 108, the cable 109 is wound around the handle 108. The cable 109, while at one end is connected to the handle 108, at the other end is connected to the frame 103 of the presser belt construction. By winding up the cable 109 on the handle 108, the frame 103 is pulled upwardly along the conbeyor belt section 30a. Upon unwinding of the handle 108, the frame 103 moves by its own weight in the opposite direction downwardly along the conveyor belt section 30*a*. The adjustment of the frame 103, of course, is provided so as to cause the presser belts 101, 102 to engage the signatures as soon as possible as the signatures begin to move up the incline. The adjustment is necessary, of course, in order to provide for different height signatures to be engaged at different points.

The apparatus 10 also includes a side guide construction for guiding the signatures as they are moved along the conveyor belts 21*a* and 30. The side guide construction is adjustable laterally in order to provide for handling of signatures of different width. The side guide construction includes a guide member 120 which is pivotally connected by a hinge 121 to a second side guide member 122. The side guide member 122 guides the signatures as they move along the inclined section 30*a*, as well as the horizontal section 30*b* of the conveyors 30. The member 120 guides the signatures as they move along the conveyor belts 21*a*. The side guides are adjustable and, in fact, the pivot connection between the side guide members 122 and 120 may also be moved laterally. There is a clamp at the opposite ends of the apparatus 10. The clamp at the rear end as shown in FIG. 2 is designated 124. When that clamp is released by rotation of the handle 125, the rear side guide member 120 can be moved laterally of the apparatus. A second clamp mechanism, generally designated 126, must be released from the rear end of the apparatus in order to permit this lateral movement.

In addition, at the hopper end of the hopper loader 10, a knob 130 is provided which may be released to permit adjustment of the side guide member 122 laterally of the machine. Upon release of the clamp mechanisms 126, 124 and 130, the side guides may be moved and even canted so as to provide the proper guiding action for the signatures. In fact, the signatures may be guided by them centrally into the hopper.

When the guides have been properly located, laterally of the stream of signatures, the various clamps may be engaged in order to lock the side guides into position. This locking action occurs merely by turning the knob 130 which locks the left end of the side guide 122, as shown in FIG. 1, to the crosspiece 135 with which the knob 130 cooperates. The rear end of the side guide 120 is locked by turning the handle 125 to effect that locking engagement. On the other hand, the latch mechanism 126 must be actuated by movement of the handle 138 thereof to a downward position, as shown in FIG. 2, which, in effect, moves a latch member 139 laterally to engage a portion of the frame at 140. Of course, any suitable latch mechanisms may be utilized in order to effect locking of the side guides in the proper position to guide the signatures to the hopper and details of the clamps will not be described, since any design may be utilized.

Figure 3:
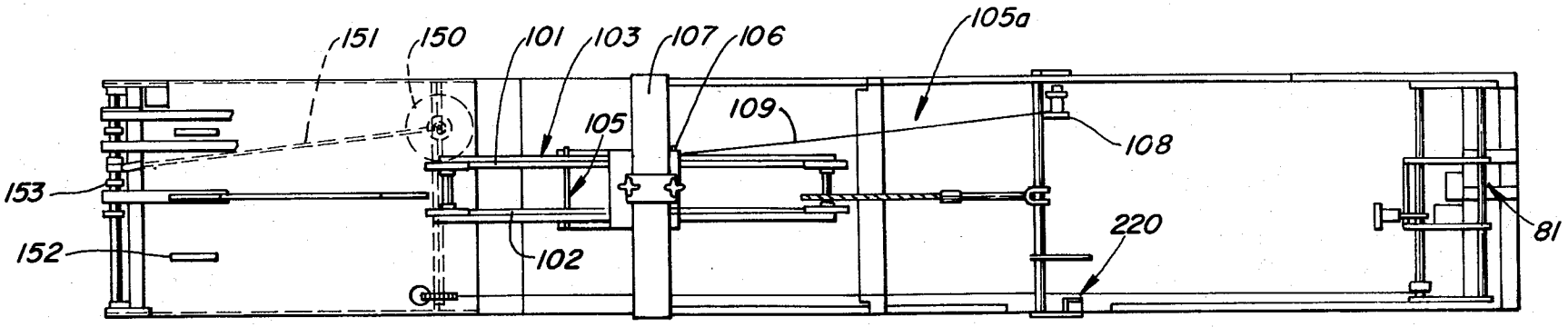
FIG. 3 is a top plan view of the hopper loader of FIG. 1 with parts removed.

From the above, it should be apparent that the present invention provides for the flow of signatures into the hopper to replenish the supply of signatures therein. As the signatures move into the hopper, a suitable jogger mechanism jogs the signatures. The jogger mechanism (see FIG. 3) includes a jogger motor 150. The jogger motor has a suitable crank mechanism 151 associated therewith which is connected with a shaft 152 which is oscillated by the crank mechanism 151. Carried on the shaft 152 is a plurality of jogger fingers or arms 153.

FIG. 9 illustrates a jogger finger which is provided in the apparatus. The jogger finger has a serrated edge, generally designated 160. The serrations on the edge of the jogger fingers provide for gripping the edge of the signatures as shown in FIG. 9 and for providing a positive action on the signatures tending to move the signatures downwardly and forwardly into the hopper, which is a desirable characteristic, in order to force the signatures into the hopper. As shown in FIG. 9, the upper end of the jogger is curved somewhat similar to the curve of the conveyor belts 30. The conveyor belts 30 have a high friction surface and the edges of the signatures should be moved out of contact with the belts 30 since the belts 30 otherwise would tend to bend the signature edges downward. The jogger, as shown, performs this function, as well as lifting and supporting the signatures as they leave the belt and then moves the signatures forwardly and downwardly. The cyclic motion of the jogger fingers also tends to vibrate the individual signatures in a horizontal plane, thus accelerating their ability to be transferred into the closely confined hopper guide walls.

The operation of the hopper loader should be apparent from the description hereinabove, but further features will be apparent from the description of the schematic circuitry shown in FIG. 8, which is incorporated in the hopper loader.

As shown in FIG. 8, the hopper loader is actuated by a start button which is located at the upper end of the hopper loader. The start button is designated 200 and is carried on a control unit 199 at the hopper end of the apparatus. When the start button 200 is depressed, a relay 201 is energized. The relay 201 has contacts 201-1 and 201-2. The contacts 201-1 of the relay 201 are normally open and are in a circuit for maintaining the relay 201 energized, even though the start button 200 is released and moves to an open condition. The circuit which includes the relay contacts 201-1, also includes contacts 202*a* of a reversing switch mechanism 202 and a stop switch 203. The reversing switch 202 and stop switch 203 are normally in the conditions illustrated in FIG. 8. The stop switch 203 is also mounted at the forward end of the hopper loader on the control unit 199, as shown in FIG. 7. From the circuitry, it should be obvious that when the stop switch is energized or depressed, the relay 201 is de-energized and thereby contacts for the relay are moved to their normal positions in which, as will be clear from the description hereinbelow, the hopper loader is stopped.

The contacts 201-1 when closed complete a circuit to the jogging motor 150 and also to the motor 40 so as to start those motors operating. The circuit to the jogging motor 150 and the motor 40 also includes a second set of switch contacts 205 of the reversing switch and also includes normally closed contacts 206-1 of a relay 206, and normally closed contacts 207-1 of a relay 207. Accordingly, it should be apparent that in the condition of the circuitry, as shown in FIG. 8, when the start switch 200 is energized, the jogging motor 150 and the motor 40 are energized.

As noted above, the belts 21*a* as well as the belts 30, are driven through the clutches 48 and 64, respectively, and when the pile-height sensor 74 is in a position in which it senses that the pile of signatures in the hopper is below the predetermined desired level, the pile-height sensor 74 takes the low pile position shown in full lines in FIG. 8. In that position a circuit is completed through the pile-height sensor 74, through the now closed contacts 201-2 of the relay 201, to a solenoid valve 208, the clutch mechanisms 64 and 48 and to a control relay 210. The circuit to the clutches 64 and 48 is also through further contacts 210 of the reversing switch 202. As a result, when the pile-height sensor 74 senses the depletion of the pile in the hopper, the clutches 64 and 48 are energized to effect actuation of the belts 21*a* and 30 to provide for replenishing of the pile in the hopper, and the solenoid valve 208 directs air flow to the nozzle 85.

After the sensor 74 is satisfied that a predetermined number of signatures is in the hopper, the sensor is moved from the full-line low pile position shown in FIG. 8 to the dotted-line high pile position in FIG. 8.

When in the dotted-line position, the sensor 74 effects the energization of the timer 80. The energization is through a circuit which is completed and which includes normally open (now closed) contacts 210-1 of the control relay 210. The switch sensor 74 is constructed so that the circuit to the timer 80 is closed before the circuit to the clutches 64, 48 opens.

When the timer 80 is energized, timer contacts 80-1 close. The contacts 80-1 are in circuit with the solenoid valve 208, the clutches 64, 48, and the control relay 210. When the contacts 80-1 are closed, the solenoid 208 remains open, the clutches 64 and 48 remain energized, as does the control relay 210, for a time interval determined by the setting of the timer 80. This occurs, even though sensor 74 has moved to its high-pile position.

When the timer has timed out, the contacts 80-1 of the timer open and accordingly at that time the solenoid valve 208 is de-energized, as are the clutches 64 and 48 and so is the control relay 210. Accordingly, the timer 80 maintains and provides for continuous feeding of signatures for a predetermined time interval after the sensor 74 has been satisfied. This time interval is adjustable due to the fact that the timer 80 is adjustable, and any conventional timer may be utilized for this purpose and details of the timer itself will not be described herein.

In addition to the above, the control circuit for the hopper loader also provides for stopping the hopper loader in the event that the amount of signatures on the conveyor belt 21 reaches a predetermined minimum. This is extremely important due to the fact that the conveyors 21*a* of the hopper loader must be loaded from the rear of the machine and that it is impossible for an operator to move along the side of the machine to load the hopper loader in situations where hopper loaders are provided at adjacent hoppers. Accordingly, in order for the hopper loader to maintain the proper supply of signatures therein so that an operator can reach far enough to maintain and replenish that supply with the signatures in abutting relationship, it is necessary to stop the hopper loader when the supply of signatures reaches a point beyond which the operator can place additional signatures into side-abutting relationship as shown in FIG. 1.

To this end, the hopper loader is provided with a limit switch, generally designated 220. The limit switch 220 is mounted on a frame member 221 and is closed when the pusher mechanism 81 moves to a predetermined position to effect the tripping of the switch 220. When the switch 220 is tripped, it closes a circuit which includes a manually settable switch 221 which may be set in any one of two positions. As shown in FIG. 8, the manually settable switch 221 is located in an up position where the circuit which is closed includes a relay 206. When the relay 206 is energized by closing of the switch 220, the relay 206 opens relay contacts 206-1 in the circuit for the jogging motor 150 and the motor 40. The opening of that circuit effects a deenergization of those motors, thus stopping the hopper loader. Also, the contacts 206-2 of the relay 206 open to de-energize the relay 201.

In order to restart the motors 150 and 40, it is necessary to load the signatures into the hopper loader which effects opening of switch 220, which de-energizes relay 206. Also, it is necessary to re-energize the relay 201 by pressing start button 200. When the relay 206 is de-energized, the normally closed contacts 206-1 and 206-2 close and thereby when the start button 200 is actuated, the jogging motor 150 and motor 40 are energized.

The manual selector switch 221 may be in the position shown in FIG. 8, or it may be in the dotted position in which the relay 207 is in the circuit with the switch 220. When the relay 207 is in the circuit with the switch 220, the belt motor and jogging motor are again de-energized when the switch 220 is opened, since in that circuit are normally closed relay contacts 207-1 and energization of motors 150 and 40. In addition, the relay 207 has contacts 207-2 which are in the circuit with the gatherer controls 230 and the gatherer motor 231. When the contacts 207-2 open, the gatherer stops and accordingly not only does the hopper loader mechanism stop, but also the gatherer stops. Accordingly, the manual selector switch 220 is settable in order to either cause the hopper loader only to stop on a malfunction or cause the hopper loader and the gathering apparatus to stop on a malfunction.

The relay 207 also has contacts 207-3 in the circuit to relay 201. Accordingly, as in the case with relay 206, it is necessary to actuate the start button 200 when the hopper loader is re-energized. This is necessary since contacts 207-3 opened when relay 207 was energized.

In addition to the above, the control circuit is such that the motor 40 for the belts 21a and 30 may be operated in a reverse direction. This is effected in order to reverse the direction of drive of the belts 21*a* and 30 so that when all of the books that are being assembled in the gathering machine have been made, the hopper loader 10 may be emptied by reversing the drive of the belts and delivering all of the signatures back onto the belts 21*a* in a stacked on-edge arrangement for removal from the hopper loader by the operator. This reversal of the drive of the motor 40 is effected by actuation of the reversing switch 202 which includes contacts 202*a*, 205, and 210 to the dotted position as shown in FIG. 8.

When the reversing switch 202 is operated, it should be clear that the relay 201 is de-energized. Accordingly, in order to reactivate the relay 201, the start button 200 must be depressed. When the start button 200 is depressed, the relay contacts 201-1 are closed and a circuit is completed to the relay 201 to maintain it energized, even though the reversing switch contacts 202a are in the dotted-line position illustrated in FIG. 8. It should be apparent also that the contacts 205 are in their dotted line position shown in FIG. 8 which provides for a reversing of the direction of operation of the motor 40. In addition, however, the circuit to the clutches 64 and 48 is maintained energized due to the fact that the contacts 210 are now in the reversing position. Accordingly, by actuating the reversing switch and pressing the start button, the belts will move in the reverse direction to feed the material in a reverse direction to the conveyor belts 21*a* for removal from the hopper loader. During this operation, it should be apparent that the jogging motor 150 is not energized.

FIG. 10 illustrates a modification of the output end of the hopper loader, which modification provides for bowing of the signatures to give them stiffness as they enter the hopper. In essence, the output end of the hopper loader is provided with a pair of guides 300, 301 which are located on the opposite sides of the conveyor belts 30. The guides extend only for a short distance adjacent the output end of the hopper loader immediately before the signatures are fed into the hopper. The guides 300, 301 engage the opposite edges of the signatures to effect the bowing as shown in FIG. 10. In addition, an idler presser belt or tape 302 is provided which presses the signatures onto the middle conveyor belt 30. The tape 302 is shown in FIGS. 1 and 2; although, without the use of the bowing feature, the tape would not be necessary.

From the above, it should be apparent that applicant has provided a substantially improved construction of a hopper loader. The improved construction includes a number of features providing substantial advantages not only in the formation of the stream of signatures, but also in the adjustment of the hopper loader for feeding of different size and thickness of signatures into the hopper and also for the removal of signatures from the hopper loader.

Having described the invention, we claim:

1. Apparatus for delivering a shingled stream of signatures to a hopper from which the signatures are fed, said apparatus comprising a generally horizontal first conveyor belt section for receiving an array of said-abutted signatures on edge, means for supporting said array of signatures in side-abutted on-edge condition on said first conveyor belt section, an inclined second conveyor belt section for engaging the side of the signatures and for feeding the signatures from the array in an overlapped stream toward the hopper, said inclined second conveyor belt section being inclined upwardly and away from said generally horizontal first conveyor belt section, sensor means for sensing the amount of signatures in the hopper and for actuating said first and second conveyor belt sections when the signatures in the hopper are less than a predetermined height, means for establishing a controlled amount of overlap of the signatures in said stream on said inclined second conveyor belt section comprising means for at least assisting in breaking the signatures from the on edge side-abutted condition away from the remaining signatures and for forcing said signatures against said inclined second conveyor belt section and means for adjusting the speed of said first conveyor belt section relative to said second conveyor belt section, and means for maintaining the established degree of overlap of the signatures on said inclined second conveyor belt section comprising presser means which engage the upper side of the signatures and hold the signatures against the inclined second conveyor belt section in the established overlap condition as they move up said inclined second conveyor belt section.

2. Apparatus as defined in claim 1 wherein said presser means includes presser belts which engage the upper side of the signatures as they move up said inclined conveyor belt section.

3. Apparatus as defined in claim 1 wherein said means for at least assisting and breaking the signatures from the on-edge side-abutted condition away from the remaining signatures and for forcing said signatures against said inclined second conveyor belt section includes means for directing an air blast against the upper edges of the signatures.

4. Apparatus as defined in claim 1 wherein said means for adjusting the speed of said first conveyor belt section relative to said second conveyor belt section includes drive means for driving said second conveyor belt section at a speed greater than said first conveyor belt section.

5. Apparatus as defined in claim 1 further including reversible drive means for driving said first and second conveyor belt sections in reverse.

6. Apparatus as set forth by claim 5 wherein said reversible drive means comprises electric motor means for driving said conveyor belt section, and means for reversing the electric motor means for driving said conveyor belt sections in reverse.

7. Apparatus as defined in claim 1 wherein said apparatus is portable and includes a movable frame, and means supporting said sensor means on said movable frame.

8. Apparatus as defined in claim 1 further including a timing means for maintaining said first and second conveyor belt sections energized for a time interval after the signatures in the hopper have been restored to a position where the sensor is inoperative to trigger actuation of said first and second conveyor belt sections.

9. Apparatus as defined in claim 1 further including side guides for guiding the signatures into the hopper, said side guides being adjustable from an end of the apparatus.

10. Apparatus as defined in claim 1 further including side guides for guiding the signatures into the hopper and clamp means releasable from an end of the apparatus for clamping the side guides in position and said side guides being adjustable when said clamp means is released.

11. Apparatus as set forth in claim 1 further including a third conveyor belt section for receiving the stream of signatures in an overlapped relationship from said inclined second conveyor belt section and for delivering the stream of signatures in an overlapped relationship into the hopper, said third conveyor belt section having a delivery end adjacent the hopper, said third conveyor belt section having a curved portion at its delivery end, and jogger means including a serrated edge jogger for engaging the signatures as they move into said hopper, said jogger having an upper curved serrated section for receiving the signatures in a stream and a vertical serrated portion for urging the signatures away from said curved portion of said third conveyor belt section.

12. Apparatus for delivering a stream of signatures to a hopper from which signatures are fed, said apparatus comprising a first conveyor belt section for receiving a stack of signatures, means for supporting signatures on edge on said first conveyor, means for driving said first conveyor belt section, a second conveyor belt section for feeding the signatures in an overlapped stream into the hopper, means for driving said second conveyor belt section at a speed in excess of said first conveyor belt section, sensor means for sensing the amount of signatures in said hopper and for activating said first and second conveyor belt sections when the supply of signatures in the hopper reaches a predetermined minimum, and means for sensing when the amount of signatures stacked upon said first conveyor belt section reaches a predetermined minimum for stopping and disabling further actuation of said conveyor belt sections in response to said sensor means in said hopper.

13. Apparatus as defined in claim 12 wherein said first conveyor belt section receives the signatures on edge in a side-abutting relationship and said second conveyor belt section has an inclined section rising upwardly from said first conveyor belt section and a horizontal section extending toward the hopper from said inclined section.

14. Apparatus as defined in claim 12 further including a control circuit which includes said means for sensing when the amount of signatures on said first conveyor belt section reaches a predetermined minimum, and switch means adjustable to stop and disable either said conveyor belt sections only or said conveyor belt sections and the mechanism feeding signatures from the hopper.

15. Apparatus as defined in claim 12 further including means for adjusting the speed of said first conveyor belt section relative to the second conveyor belt section.

16. Apparatus as defined in claim 12 further including electric motor means for driving said conveyor belts, and means for reversing said electric motor means for driving said conveyor belt sections in reverse.

17. Apparatus as defined in claim 12 further including a timing means for maintaining said first and second conveyor belt sections energized for a time interval after the signatures in the hopper have been restored to a position where the sensor is inoperative to trigger actuation of said first and second conveyor belt sections.

18. Apparatus for delivering a shingled stream of signatures to a hopper from which the signatures are fed, said apparatus comprising a generally horizontal first conveyor belt section for receiving an array of side-abutted signatures on edge, a second conveyor belt section for feeding the signatures in an overlapped stream into the hopper, means for driving said second conveyor belt section at a speed in excess of said first conveyor belt section, sensor means for sensing the amount of signatures in said hopper and for activating said first and second conveyor belt sections when the supply of signatures in the hopper reaches a predetermined minimum, means at one end of said apparatus for adjusting the speed of said first conveyor belt section relative to said second conveyor belt section, presser belts which engage the upper side of the signatures as they move along said second conveyor belt section, and means at one end of said hopper loader for adjusting the position of said presser belts along said second conveyor belt section.

19. Apparatus as defined in claim 18 further including side guides for guiding the signatures into said hopper, and releasable clamp means at each end of said apparatus for said side guides and which when released permit adjustment of said side guides laterally of said apparatus.

20. Apparatus as defined in claim 18 further including jogger means for jogging the signatures as they are delivered into said hopper, said jogger means including at least one jogger finger having a serrated edge engageable with the edge of the signatures, and means for oscillating said jogger to effect jogging of the signatures into the hopper.

* * * * *